US010557290B2

(12) United States Patent
Scholz et al.

(10) Patent No.: US 10,557,290 B2
(45) Date of Patent: Feb. 11, 2020

(54) MOTOR VEHICLE DOOR

(71) Applicant: Kiekert Aktiengesellschaft, Heiligenhaus (DE)

(72) Inventors: Michael Scholz, Essen (DE); Holger Schiffer, Meerbusch (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 496 days.

(21) Appl. No.: 14/907,970

(22) PCT Filed: Jul. 9, 2014

(86) PCT No.: PCT/DE2014/100239
§ 371 (c)(1),
(2) Date: Apr. 12, 2016

(87) PCT Pub. No.: WO2015/014342
PCT Pub. Date: Feb. 5, 2015

(65) Prior Publication Data

US 2016/0222700 A1 Aug. 4, 2016

(30) Foreign Application Priority Data

Jul. 31, 2013 (DE) ..... 10 2013 108 221

(51) Int. Cl.
*E05B 77/36* (2014.01)
*E05B 77/42* (2014.01)
(Continued)

(52) U.S. Cl.
CPC ..... *E05B 77/36* (2013.01); *E05B 77/42* (2013.01); *E05B 79/10* (2013.01); *E05B 85/045* (2013.01); *E05B 85/243* (2013.01)

(58) Field of Classification Search
CPC ..... E05B 77/36; E05B 77/38; E05B 77/42; E05B 77/00; E05B 79/10; E05B 79/00; E05B 85/045; E05B 85/243; E05B 85/00
(Continued)

(56) References Cited

U.S. PATENT DOCUMENTS 4,358,141 A * 11/1982 Hamada ..... E05B 85/243 292/216
4,756,564 A * 7/1988 Ikeda ..... E05B 85/26 292/216
(Continued)

FOREIGN PATENT DOCUMENTS

DE 1801154 A1 4/1970
DE 10019668 A1 10/2001
(Continued)

OTHER PUBLICATIONS

Machine Translation of DE102005016186A1 by Lexis Nexis Total Patent on Apr. 5, 2016.
(Continued)

*Primary Examiner* — Nathan Cumar
(74) *Attorney, Agent, or Firm* — Woodard, Emhardt, Henry, Reeves & Wagner, LLP

(57) ABSTRACT

The invention relates to a motor vehicle door which is fitted with a motor vehicle door lock and an associated locking bolt and with a stop device with corresponding damping elements. Said stop device interacts, at least when the locking bolt engages in the motor vehicle door lock, with the relevant locking bolt for damping the movements thereof. According to the invention, said stop device is fitted with at least one deflection lever and a transmission lever. In this respect, the deflection lever interacting with the locking bolt is designed to at least partially absorb the movement of the locking bolt.

21 Claims, 2 Drawing Sheets

(51) Int. Cl.
*E05B 79/10* (2014.01)
*E05B 85/04* (2014.01)
*E05B 85/24* (2014.01)

(58) Field of Classification Search
USPC ... 292/200, 1, 240, 241, 242, 194, 215, 217, 292/210, DIG. 16, DIG. 5, DIG. 67
See application file for complete search history.

(56) References Cited

U.S. PATENT DOCUMENTS

| | | | | |
|---|---|---|---|---|
| 5,308,128 | A * | 5/1994 | Portelli | E05B 77/265 292/216 |
| 2002/0000724 | A1* | 1/2002 | Kalargeros | E05B 85/26 292/195 |
| 2009/0044378 | A1 | 2/2009 | Jankowski et al. | |
| 2015/0315827 | A1* | 11/2015 | Bendel | E05B 77/36 292/195 |

FOREIGN PATENT DOCUMENTS

| | | | |
|---|---|---|---|
| DE | 102005016186 | A1 | 10/2006 |
| DE | 102008010002 | A1 | 10/2009 |
| EP | 2067917 | A2 | 6/2009 |
| FR | 2848235 | A1 | 6/2004 |

OTHER PUBLICATIONS

Machine Translation of DE102008010002A1 by Lexis Nexis Total Patent on Apr. 5, 2016.
Machine translation of DE10019868A1 by Patent Translate European Patent Office on Sep. 9, 2019 (pp. 37).
Machine translation of DE1801154A1 by Patent Translate European Patent Office on Sep. 9, 2019 (pp. 27).
Machine translation of FR2848235A1 by Patent Translate European Patent Office on Sep. 9, 2019 (pp. 40).
Office Action issued in related German Patent Application No. 10 2013 108 221.1 on May 16, 2014.

* cited by examiner

MOTOR VEHICLE DOOR

BACKGROUND

The invention relates to a motor vehicle door, with a motor vehicle door latch and a pertaining locking bolt, and with a stop device with corresponding attenuation element, whereby the stop device interacts at least on the locking bolt entering the motor vehicle door latch with the relevant locking bolt for the attenuation of its movement.

The aforementioned motor vehicle door is a motor vehicle side door or also a tailgate. The motor vehicle door latch may be arranged inside the motor vehicle door in question, but it can also be connected to a pertaining motor vehicle chassis. Consequently, the locking bolt interacting with the motor vehicle door latch is located on a doorpost for one variant, for example, whereas the other variant is equipped or can be equipped with a locking bolt on the motor vehicle door.

In both cases in principle considerable noises occur when the motor vehicle door is closed. This can essentially be attributed to the fact that both the locking bolt and a locking mechanism interacting with the locking bolt inside the motor vehicle door latch are robust and metallic respectively in order for example to transfer forces arising in the event of an accident and to prevent unintentional opening of the motor vehicle door. Although in the state of the art diverse approaches have been pursued to reduce or attenuate these 'metallic closure noises'. However, the solutions proposed thus far are not convincing in all aspects.

Thus, the category-defining DE 10 2005 016 186 A1 describes a latch with a stop device which demonstrates a pivoting section. On the pivoting section, the locking bolt lies adjacent when the pertaining motor vehicle door is closed. When the motor vehicle door is closed again, an attenuation element and/or a spring element on the pivoting part cause a force or a torque. With the aid of the force or the torque, an energetic closure of the motor vehicle door is attenuated or decelerated.

The solution pursued in accordance with the state of the art is kinematically complicated and requires relevant adjustments inside the motor vehicle door latch. This is disadvantageous from an installation and cost perspective due to the expense associated with it. Added to this is the fact that the known solution is difficult to combine with different motor vehicle door latches. This is where the invention as a whole wishes to provide assistance.

SUMMARY

The invention is based on the technical problem of further developing a motor vehicle door in such a way that constructional and installation costs are reduced and the possibility of a retrofit solution exists.

In order to solve this technical problem, for a category-defining motor vehicle door the invention proposes that the stop device is equipped with at least one deflection lever and a transfer lever, whereby the deflection lever interacting with the locking bolt alone is set up at least in part to absorb the movement of the locking bolt. i.e, the deflection lever alone is capable of partially absorbing the movement of the locking bolt without the transfer lever and the attenuation element. Only the further course of the locking bolt is then additionally attenuated with the attenuation element.

Within the scope of the invention therefore, in the first instance the stop device is fundamentally reduced to two elements, the deflection lever and the transfer lever. The aforementioned lever arrangement works overall on the attenuation element envisaged on the outlet side in order to finally attenuate the movement of the locking bolt during closure of the motor vehicle door in relation to the motor vehicle chassis. In addition to the attenuation element, the deflection lever interacting with the locking bolt in accordance with the invention is at least partially set up to absorb the movement of the locking bolt or its movement. This means the deflection lever is designed in relation to its characteristics or features in such a way that it can partially absorb the movement of the locking bolt without the transfer lever and the attenuation element acting or being appreciably pressurized.

For this purpose, the deflection lever has movement absorption or impulse absorption for the locking bolt. This movement absorption or impulse absorption of the deflection lever is generally only effective over a certain course of the locking bolt. The impulse absorption usually works until at most the halfway point of the entire course of the locking bolt. The other half of the course of the locking bolt is then typically attenuated with the aid of the attenuation element.

This means that the course of the locking bolt is crucially subdivided into an attenuation course of the movement absorption or impulse absorption of the deflection lever on the one hand and the attenuation for the locking bolt exerted by the attenuation element on the other hand. Thus, a staggered impulse absorption or movement absorption of the locking bolt can be undertaken. The invention is based on the recognition that a relatively large or strong movement impulse is initially exerted on the stop device by the locking bolt which reduces with increasing course.

In the specific case, for example at the start of the closure process, impulse energy up to maximum 40 joules is observed which is practically exclusively absorbed by the deflection lever or the movement absorption or impulse absorption provided for there within the scope of the invention. With increasing course, the impulse energy is reduced and in the example case from the halfway point of the course of the locking bolt during the closure process attenuation can only take place with the aid of the attenuation element. Thus, the invention provides a stop device which is optimally tailored to the impulse energy occurring.

In actual fact, work ultimately takes place with a staggered impulse absorption in such a way that the movement absorption or impulse absorption on the deflection lever absorbs high impulses of the locking bolt at the start of the closure process, whereas the attenuation element pressurized by the lever arrangement on the outlet side is provided for the second half of the course and undertakes movement attenuation here.

This all succeeds taking into account a simple construction which is not difficult to retrofit due to the few components necessary, namely a deflection lever, a transfer lever and finally an attenuation element.

In actual fact, the stop device including the corresponding attenuation element overall can be formed modularly as an attenuation module and can thus be easily retrofitted, even where motor vehicle door latches are present. This means that the attenuation module on the one hand and the motor vehicle door latch on the other hand are respective constructional units which can be optionally modularly combined and for example fixed separately or together to the pertaining motor vehicle door. These are the crucial advantages.

The impulse absorption or movement absorption of the deflection lever is in principle an attenuation element and/or an offsetting contour on the deflection lever. This means that the impulse absorption or movement absorption on the deflection lever constitutes a component of the deflection lever. In the case of the attenuation element, this could be a buffer or a similar attenuation element, with the help of which the impulse energy is absorbed in particular at the start of the course of the locking bolt during the closure process of the motor vehicle door.

The offsetting contour alternatively or additionally provided for in this context is generally designed in such a way that it corresponds to a pivoting movement of the deflection lever without the transfer lever (and also the attenuation element) being pressurized by the pivoted deflection lever. This means that the impulse energy of the locking bolt is initially transformed into a rotational movement or pivoting movement of the deflection lever. Only after a certain course of the locking bolt does the deflection lever ensure that the transfer lever is also pressurized and its movement experiences attenuation with the aid of the attenuation element.

For this purpose, the deflection lever possesses advantageously not only the offsetting contour already mentioned, but also a control contour which is suitable and set up for interaction with the transfer lever. The design is usually such that the offsetting contour and the control contour of the deflection lever are respectively arranged on an edge of the deflection lever turned away from the locking bolt.

Furthermore, the offsetting contour and the control contour regularly connect and define a contour changing area between themselves. When the motor vehicle door is closed and the locking bolt consequently interacts with the edge turned towards the locking bolt, this closure movement therefore initially ensures that the deflection lever is pivoted around its pertaining rotational axis. In this process, the offsetting contour glides along on the edge of the deflection lever on the transfer lever turned away from the locking bolt or a reaction contour on the transfer lever. In this process, the transfer lever is not pivoted or at most only slightly. This means that the attenuation element is not used or is virtually not used.

With the advancing closure movement of the motor vehicle door and consequently further movement of the locking bolt, the contour changing area initially passes the reaction contour of the transfer lever, following the offsetting contour. Subsequently, the control contour can interact with the reaction contour. The consequence of this is that the transfer lever is pivoted around its rotational axis and works on the attenuation element. The movement of the locking bolt is thus attenuated.

As a result, a motor vehicle door is provided which is equipped with an attenuation or stop device for the locking bolt of an especially simple construction. This results in cost advantages in manufacture and also advantages in installation. This only applies to an execution form in which the stop device forms an attenuation module together with the corresponding attenuation element which can be retrofitted, for example.

The object of the invention is also a procedure for attenuation of the closure movement of a relevantly constructed motor vehicle door, as described in claim 10.

BRIEF DESCRIPTION OF THE DRAWING

Hereinafter, the invention is explained in further detail on the basis of a sketch which only depicts an execution example.

DETAILED DESCRIPTION OF THE DRAWING

Figure 1:
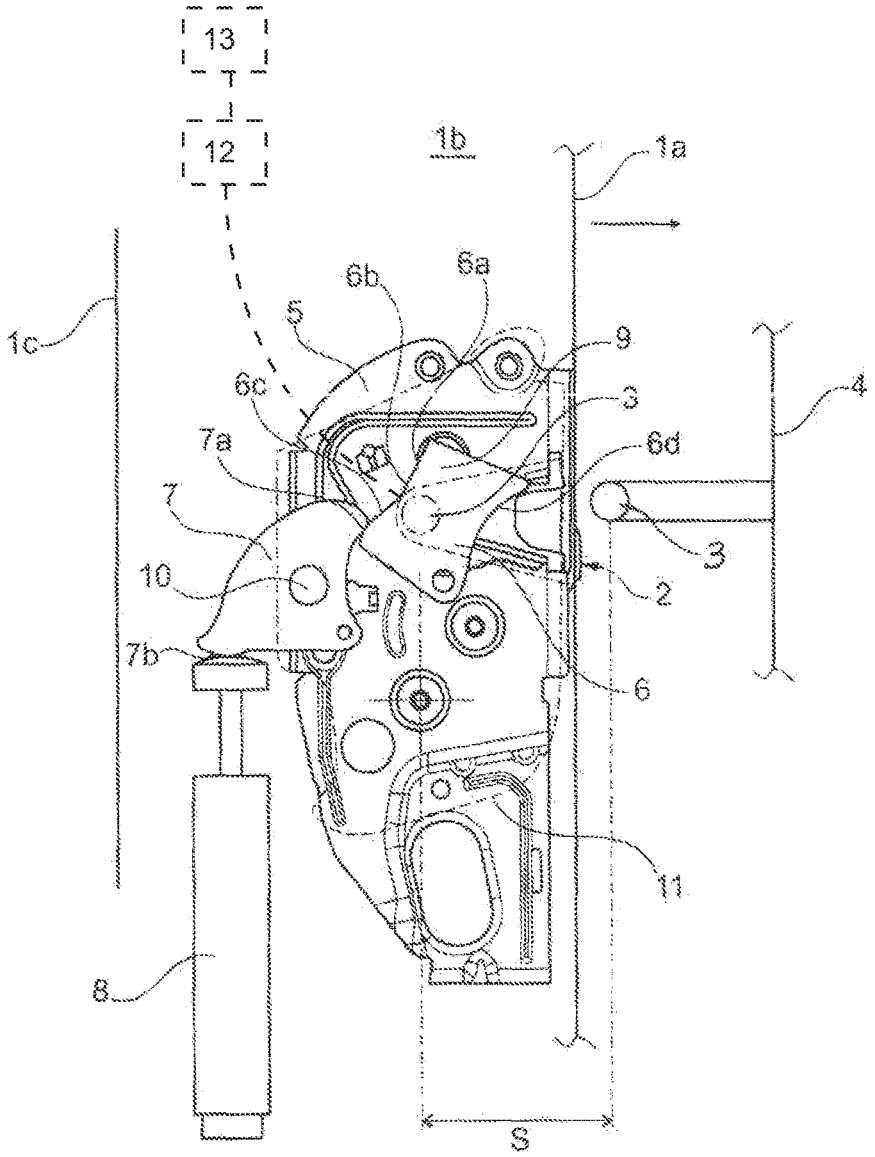
FIG. 1 shows a plan view of the motor vehicle door in accordance with the invention with a motor vehicle door latch, locking bolt and pertaining stop device with corresponding attenuation element in diagrammatic form.

The FIGURE depicts a motor vehicle door which comprises in principle an internal door panel 1*a*, a connecting panel 1*b* and finally an external door panel 1*c*. The only depiction in the FIGURE shows a view of the connecting panel 1*b* connecting the internal door panel 1*a* and the external door panel 1*c*. The connecting panel 1*b* may be located on the front side of the motor vehicle door formed as a motor vehicle side door. The front side in question or the connecting panel 1*b* is equipped with an infeed section 2 for a locking bolt 3. The locking bolt 3 is connected to a motor vehicle chassis or in the present case a doorpost 4 of the motor vehicle chassis.

As soon as the motor vehicle door is closed to the right in the arrow direction depicted, the locking bolt 3 enters the infeed section 2 and can thus interact with a motor vehicle door latch 5 or a locking mechanism of the motor vehicle door latch 5 which is not depicted. Both the start position traversed and the end position of the locking bolt 3 shown in semi-colons corresponded to this. Furthermore, a course completed by the locking bolt 3 hereby. As usual, the locking mechanism comprises a catch 12 and a pawl 13. In the example shown, the motor vehicle door latch 5 is arranged 'behind' the connecting panel 1*b*.

The locking bolt 3 entering the motor vehicle door latch 5 via the infeed section 2 ensures that the catch 12 and also the entire locking mechanism is initially transferred into a pre-latching position and then a main latching position. The main latching position regularly corresponds to the motor vehicle door being closed in relation to the motor vehicle chassis 4. The internal door panel 1*a* is then located in direct proximity to the doorpost 4 or the motor vehicle chassis 4, whereby here only a compressed rubber door seal is interposed.

In order to now attenuate the movement of the locking bolt 3 along its entire course or at least a part of its course, a stop device 6, 7 is provided for with a corresponding attenuation element 8. In the execution example the stop device 6, 7 comprises a deflection lever 6 and a transfer lever 7. The transfer lever 7 works on the attenuation element 8, whereas the deflection lever 6 interacts with the locking bolt 3, as explained in greater detail below.

The attenuation element 8 may be a hydraulic attenuator, an elastomer attenuator, a spring attenuator or also combinations thereof. The attenuation element 8 generally ensures that the locking bolt 3 is decelerated or its movement attenuated along its course. This occurs within the scope of the invention in such a way that a staggered impulse absorption of the movement impulse transferred from the locking bolt 3 to the motor vehicle door latch 5 takes place.

The deflection lever 6 interacting with the locking bolt 3 in accordance with the invention for this purpose is at least partially set up to absorb the movement of the locking bolt 3. This means the movement of the locking bolts 3 along its course is at least partly absorbed by the deflection lever 6 alone, This means without additional pressurization of the transfer lever 7 and consequently the attenuation element 8.

For this purpose, the deflection lever 6 is equipped with a movement absorption or impulse absorption 6*a* in accordance with the invention. In actual fact, the deflection lever 6 in the present case is formed as a deflection lever and pivotably located around a pertaining rotational axis 9. The rotational axis 9 is typically defined by a pertaining bolt for absorption of the deflection lever 6. This bolt can be connected to an adapter plate 11 indicated by dotted lines or also a latch 5, which describes the motor vehicle door latch 5 in the execution example. The adapter plate 11 is arranged between the connecting panel 1*b* and the latch 5.

The transfer lever 7 in the present case is formed as a deflection lever. Like the deflection lever 6, the transfer lever 7 also possesses a pertaining rotational axis 10, defined by a bolt 10. The bolt 10 may again be connected to the adapter plate 11 or the latch 5.

The movement absorption or impulse absorption 6*a* in the execution example is an offsetting contour 6*a* on the deflection lever 6. Furthermore, the deflection lever 6 demonstrates another inlet contour 6*d*, which is turned towards the locking bolt 3 and interacts with it. Furthermore, the deflection lever 6 is equipped with a control contour 6. In the execution example, the impulse absorption or offsetting contour 6*a* and the control contour 6*c* are connected via a contour changing area 6*b*. This means that the control contour 6*c* connects to the offsetting contour 6*a* and both contours 6*a*, 6*c* are connected by means of the contour changing area 6*b*. The control contour 6*c*, the contour changing area 6*b* and the offsetting contour 6*a* are arranged on the edge of the deflection lever 6 turned away from the locking bolt 3.

The transfer lever 7 has a reaction contour 7*a*. According to the position of the deflection lever 6 the reaction contour 7*a* of the transfer lever 7 interacts with the offsetting contour 6*a* on the one hand or the control contour 6*c* of the deflection lever 6 on the other hand. In the change of the adjacency of the reaction contour 7*a* from the offsetting contour 6*a* to the control contour 6*c* naturally an interaction of the reaction contour 7*a* of the transfer lever 7 with the contour changing area 6*b* of the deflection lever takes place in the short term. Finally, the transfer lever 7 is equipped with an attenuation contour 7*b* in addition to the reaction contour 7*a*. The attenuation contour 7*b* of the transfer lever 7 works on the attenuation element 8.

Figure 2:
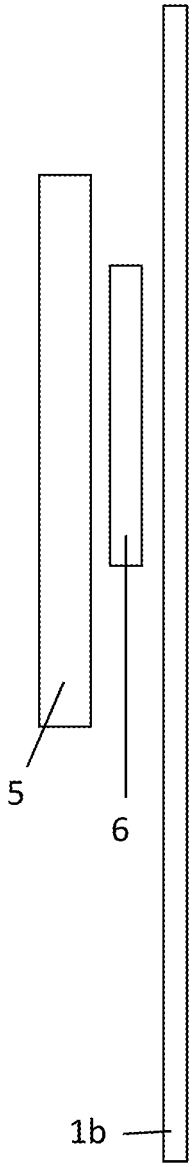
FIG. 2 shows a side view of the motor vehicle door latch, stop device and internal door panel in accordance with one embodiment of the invention.
Figure 3:
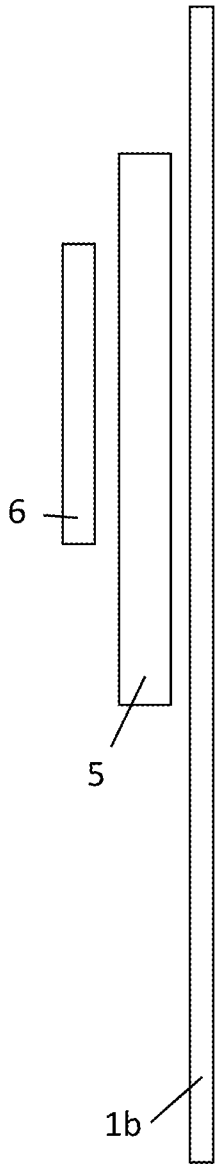
FIG. 3 shows a side view of the motor vehicle door latch, stop device and internal door panel in accordance with an alternative embodiment of the invention.

The stop device 6, 7 can be of a modular construction overall—with or without the attenuation element 8. In the execution example, the adapter plate 11 which houses the bolt 9, 10 and thus defines the rotational axes 9, 10 for the deflection lever 6 on the one hand and the transfer lever 7 on the other hand is indicated in dotted lines. Thus, the stop device 6, 7 is regularly arranged between the adapter plate 11 and the latch 5 in the intermediate space defined there. Because the adapter plate 11 is connected to the latch 5 or screwed to this, for example, with the interposition of spacer sleeves. Thus, the attenuation module, 6, 7, 9. 10, 11 defined thus can optionally be interposed between the motor vehicle door latch 5 and the connecting panel 1*b* as shown in FIG. 2. Alternatively, latch 5 can optionally be interposed between attenuation module 6, 7, 9, 10, 11 and connecting panel 1*b* as shown in FIG. 3.

It operates as follows. A closure movement of the motor vehicle door in relation to the motor vehicle chassis 4 indicated by an arrow in the FIGURE corresponds to the internal door panel 1*a* approaching the doorpost or the motor vehicle chassis 4 in general. Thus, the locking bolt 3 can enter the infeed section 2. The locking bolt 3 completes the course overall in this process. By means of this relative movement of the locking bolt 3 compared to the motor vehicle door latch 5 on the one hand the locking mechanism which is not depicted is transferred into the motor vehicle door latch 5, initially into its pre-latching position and then into its main latching position. On the other hand, the locking bolt 3 ensures that the stop device 6, 7 and the attenuation element 8 is pressurized and thus ensures movement attenuation of the locking bolt 3. This means that the locking bolt 3 is decelerated in this process, its movement is attenuated. Thus, the noise evolution in relation to previous execution forms is also considerably improved.

In order to achieve this in detail, the stop device 6, 7 possesses the deflection lever 6 and the transfer lever 7, which are both connected via shifting contours 6*a*, 6*b* 6*c* on the one hand and 7*a* on the other hand are mechanically connected. In actual fact, the deflection lever 6 possesses relevant movement absorption or impulse absorption 6*a*, which is at least partially set up for the movement absorption of the locking bolt 3 alone.

In principle, the deflection lever 6 could also be equipped on its inlet contour 6*d* turned towards the locking bolt 3 with a buffer pocket or a comparable attenuation element, which is not depicted within the scope of the execution example, however.

In accordance with the invention, the stop device 6, 7 accomplishes a staggered impulse absorption of the movement impulse transferred from the locking bolt 3 to the motor vehicle door latch 5. To this end, the movement absorption or impulse absorption 6*a* is only effective over a certain part of the course of the locking bolt 3. In the execution example, the design is such that the impulse absorption or movement absorption 6*a* or the offsetting contour 6*a* used at this point on the deflection lever 6 only works or is effective up to a maximum of half of the entire course of the locking bolt 3, and starting with the position of the locking bolt 3 pertaining to the open position of the door and depicted traversed.

This means that the starting position of the deflection lever 6 not depicted in the sole FIGURE corresponds to the reaction contour 7*a* of the transfer lever 7 being adjacent on the offsetting contour 6*a* of the deflection lever 6. Pertaining to this is a pivoting movement of the deflection lever 6 starting from the depicted position in the sole FIGURE around the pertaining rotational axis 9 in an anti-clockwise direction.

If only the locking bolt 3 enters the infeed section 2, it meets the inlet contour 6*d*, which is initially designed in an arched shape and then runs straight. Thus, the deflection lever 6 is pivoted around its rotational axis 9 in a clockwise direction. As a consequence of this, the reaction contour 6*a* of the transfer lever 7 initially glides along the offsetting contour 6*a*. As the offsetting contour 6*a* is more or less straight in this process in the first half of the course of the locking bolt 3 and only a slight pivoting movement is generated by the clockwise movement of the deflection lever 6, the reaction contour 7*a* of the transfer lever 7 is not or practically not pressurized. This means the locking bolt 3 in the first area or the first half of its course experiences attenuation such that its movement is transformed into a rotational movement of the deflection lever 6, which does not however or virtually does not lead to additional pressurization of the attenuation element 8.

Only if the locking bolt 3 has pivoted the deflection lever 6 so far in a clockwise direction around its rotational axis 9 that the reaction contour 7*a* on the transfer lever 7 initially reaches the contour changing area 6*b* and subsequently the control contour 6*c*, the attenuation element 8 is pressurized. Because this process primarily depicted in the FIGURE corresponds to the control contour 6*c* at an angle in relation to the offsetting contour 6*a* elevating the reaction contour 7*a* of the transfer lever 7 so to speak. In any case, the adjacency of the control contour 6*c* on the reaction contour 7*a* of the transfer lever 7 pivots this transfer lever 7 around its rotational axis 10 in an anti-clockwise direction. As a consequence hereof, the attenuation contour 7*b* works on the attenuation element 8 and (additionally) the locking bolt 3 is hereby attenuated in its movement.

Thus, an especially effective attenuation is provided. Because the impulse of the locking bolt 3 on the motor vehicle door latch 5 is converted in a staggered manner on the one hand into a pivoting movement of the deflection lever 6 and on the other hand into a combined pivoting movement of both levers 6, 7 including additional attenuation with the aid of the attenuation element 8. Thus, the energy associated with the movement impulse in question can be absorbed especially effectively and via a significant course or ultimately the entire course of the locking bolt 3 and ultimately converted into heat. As a consequence hereof, considerably improved noise evolution must be reckoned with in relation to the state of the art.

The invention claimed is:

1. A motor vehicle door, with a motor vehicle door latch having a catch, a pawl, an infeed section and pertaining locking bolt that traverses a course through the infeed section to a pre-latching position to a main latching position, the motor vehicle door comprising:

a stop device positioned externally from the motor vehicle door latch, the stop device comprising:

a deflection lever positioned to directly contact the locking bolt when the locking bolt moves along the course through the infeed section, wherein movement of the locking bolt along the course through the infeed section moves the deflection lever and attenuates movement of the locking bolt; and a transfer lever, wherein movement of the deflection lever directly moves the transfer lever.

2. The motor vehicle door in accordance with claim 1, wherein the deflection lever is equipped with impulse absorption for the locking bolt.

3. The motor vehicle door in accordance with claim 2, wherein the impulse absorption is effective via a course of the locking bolt through the infeed section.

4. The motor vehicle door in accordance with claim 3, wherein the impulse absorption works up to a maximum of half of an entire course of the locking bolt through the infeed section.

5. The motor vehicle door in accordance with claim 2, wherein the impulse absorption comprises an attenuation element and offsetting contour defined on the deflection lever.

6. The motor vehicle door in accordance with claim 5, wherein the deflection lever defines a control contour for interaction with the transfer lever.

7. The motor vehicle door in accordance with claim 6, wherein the offsetting contour and the control contour of the deflection lever are arranged on an edge turned away from the locking bolt.

8. The motor vehicle door in accordance with claim 6, wherein the offsetting contour and the control contour connect to one another and define a contour changing area.

9. The motor vehicle door in accordance with claim 8, further comprising an attenuation element, wherein the attenuation element attenuates movement of the transfer lever which attenuates movement of the deflection lever.

10. A procedure for attenuation of the closure movement of a motor vehicle door, with a motor vehicle door latch having a catch, a pawl, an infeed section and pertaining locking bolt, the procedure comprising:

positioning a deflection lever and a transfer lever externally from the motor vehicle door latch;

moving the locking bolt toward the catch;

before the locking bolt contacts the catch, directly contacting the locking bolt with the deflection lever;

after directly contacting the locking bolt with the deflection lever, attenuating further movement of the locking bolt toward the catch by moving the deflection lever with the locking bolt; and wherein moving the deflection lever directly moves the transfer lever.

11. The motor vehicle door in accordance with claim 2, wherein the impulse absorption comprises an attenuation element on the deflection lever.

12. The motor vehicle door in accordance with claim 11, wherein the deflection lever defines a control contour for interaction with the transfer lever.

13. The motor vehicle door in accordance with claim 12, wherein the control contour of the deflection lever is arranged on an edge turned away from the locking bolt.

14. The motor vehicle door in accordance with claim 2, wherein the impulse absorption comprises an offsetting contour defined on the deflection lever.

15. The motor vehicle door in accordance with claim 14, wherein the deflection lever demonstrates a control contour for interaction with the transfer lever.

16. The motor vehicle door in accordance with claim 15, wherein the offsetting contour and the control contour of the deflection lever are arranged on an edge turned away from the locking bolt.

17. The motor vehicle door in accordance with claim 16, wherein the offsetting contour and the control contour connect to one another and define a contour changing area.

18. The motor vehicle door in accordance with claim 9, wherein the attenuation element is selected from the group consisting of: a hydraulic attenuator, an elastomer attenuator, a spring attenuator and combinations thereof.

19. The motor vehicle door in accordance with claim 1, wherein the deflection lever extends over the infeed section of the of the motor vehicle door latch so that the deflection lever contacts the locking bolt when the locking bolt is positioned within the infeed section.

20. The motor vehicle door in accordance with claim 1, further comprising an attenuation element, wherein the attenuation element attenuates movement of the transfer lever which further attenuates movement of the deflection lever.

21. The motor vehicle door in accordance with claim 1, further comprising a connecting panel, wherein the motor vehicle door latch is arranged behind the connecting panel and wherein the deflection lever is interposed between the motor vehicle door latch and the connecting panel or the motor vehicle door latch is interposed between the deflection lever and the connecting panel.

* * * * *